US009103009B2

(12) United States Patent
Prest et al.

(10) Patent No.: US 9,103,009 B2
(45) Date of Patent: Aug. 11, 2015

(54) METHOD OF USING CORE SHELL PRE-ALLOY STRUCTURE TO MAKE ALLOYS IN A CONTROLLED MANNER

(75) Inventors: Christopher D. Prest, San Francisco, CA (US); Joseph C. Poole, San Francisco, CA (US); Matthew S. Scott, Campbell, CA (US); Dermot J. Stratton, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 527 days.

(21) Appl. No.: 13/541,708

(22) Filed: Jul. 4, 2012

(65) Prior Publication Data

US 2014/0007987 A1 Jan. 9, 2014

(51) Int. Cl.

| | |
|---|---|
| ***C22F 1/00*** | (2006.01) |
| ***C22C 1/00*** | (2006.01) |
| ***C22C 1/04*** | (2006.01) |
| ***C22F 1/18*** | (2006.01) |
| ***B22F 1/00*** | (2006.01) |
| ***B22F 9/00*** | (2006.01) |
| ***C22C 33/02*** | (2006.01) |
| *B22F 1/02* | (2006.01) |

(52) U.S. Cl.

CPC ..... *C22F 1/00* (2013.01); *B22F 1/0085* (2013.01); *B22F 9/002* (2013.01); *C22C 1/002* (2013.01); *C22C 1/0425* (2013.01); *C22C 1/0458* (2013.01); *C22C 1/0466* (2013.01); *C22C 33/0278* (2013.01); *C22F 1/186* (2013.01); *B22F 1/025* (2013.01)

(58) Field of Classification Search

CPC ..... B22F 1/0085; B22F 1/025; B22F 9/002; C22F 1/00; C22F 1/186; C22C 1/002; C22C 1/0425; C22C 1/0458; C22C 1/0466; C22C 33/0278

USPC ..... 148/561, 403, 516

See application file for complete search history.

(56) References Cited

U.S. PATENT DOCUMENTS

| | | | | |
|---|---|---|---|---|
| 4,830,262 | A | | 5/1989 | Ishibe |
| 5,198,043 | A | | 3/1993 | Johnson |
| 5,288,344 | A | | 2/1994 | Peker |
| 5,368,659 | A | | 11/1994 | Peker |
| 5,618,359 | A | | 4/1997 | Lin |
| 5,735,975 | A | | 4/1998 | Lin |
| 5,741,604 | A | | 4/1998 | Deakin |
| 6,010,580 | A | * | 1/2000 | Dandliker et al. ..... 148/403 |

(Continued)

FOREIGN PATENT DOCUMENTS

JP 2001-303218 10/2001

OTHER PUBLICATIONS

Inoue et al., "Bulk amorphous alloys with high mechanical strength and good soft magnetic properties in Fe—Tm—B (TM=IV-VIII group transition metal) system", Appl. Phys. Lett., vol. 71, p. 464, May 1997.

(Continued)

*Primary Examiner* — Helene Klemanski

(74) *Attorney, Agent, or Firm* — Brownstein Hyatt Farber Schreck, LLP

(57) ABSTRACT

Disclosed herein are methods of combining at least one bulk-solidifying amorphous alloy and at least one additional metal or alloy of a metal to provide a composite preform. The composite preform then is heated to produce an alloy of the bulk-solidifying amorphous alloy and the at least one additional metal or alloy of the metal.

18 Claims, 4 Drawing Sheets

(56) References Cited

U.S. PATENT DOCUMENTS

| | | | | |
|---|---|---|---|---|
| 6,325,868 | B1 | 12/2001 | Kim | |
| 6,818,078 | B2 * | 11/2004 | Kim et al. | 148/561 |
| 7,575,040 | B2 | 8/2009 | Johnson | |
| 2003/0140987 | A1 * | 7/2003 | Bae et al. | 148/403 |
| 2006/0130943 | A1 * | 6/2006 | Peker | 148/561 |
| 2007/0079907 | A1 | 4/2007 | Johnson | |
| 2008/0029760 | A1 | 2/2008 | Jun | |
| 2010/0084052 | A1 | 4/2010 | Farmer | |
| 2010/0289003 | A1 | 11/2010 | Kahen | |
| 2013/0306197 | A1 * | 11/2013 | Prest et al. | 148/403 |
| 2013/0306199 | A1 * | 11/2013 | Prest et al. | 148/403 |
| 2014/0007982 | A1 * | 1/2014 | Prest et al. | 148/403 |
| 2014/0011050 | A1 * | 1/2014 | Poole et al. | 148/403 |

OTHER PUBLICATIONS

Shen ET., "Bulk Glassy CO43FE20TA5.5B31.5 Alloy with High Glass-Forming Ability and Good Soft Magnetic Properties", Materials Transactions, vol. 42 No. 10 (2001) pp. 2136-2139, Aug. 2001.

J. Schroers, B. Lohwongwatana, W. L. Johnson and A. Peker, Applied Physics Letters 87 061912, Aug. 2005.

C. C. Hays, C. P. Kim and W. L. Johnson, Physical Review Letters 84, 2901-2904, Mar. 2000.

* cited by examiner

PRIOR ART

PRIOR ART

METHOD OF USING CORE SHELL PRE-ALLOY STRUCTURE TO MAKE ALLOYS IN A CONTROLLED MANNER

All publications, patents, and patent applications cited in this Specification are hereby incorporated by reference in their entirety.

BACKGROUND

A large portion of the metallic alloys in use today are processed by solidification casting, at least initially. The metallic alloy is melted and cast into a metal or ceramic mold, where it solidifies. The mold is stripped away, and the cast metallic piece is ready for use or further processing. The as-cast structure of most materials produced during solidification and cooling depends upon the cooling rate. There is no general rule for the nature of the variation, but for the most part the structure changes only gradually with changes in cooling rate. On the other hand, for the bulk-solidifying amorphous alloys the change between the amorphous state produced by relatively rapid cooling and the crystalline state produced by relatively slower cooling is one of kind rather than degree—the two states have distinct properties.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. This amorphous state can be highly advantageous for certain applications. If the cooling rate is not sufficiently high, crystals may form inside the alloy during cooling, so that the benefits of the amorphous state are partially or completely lost. For example, one risk with the creation of bulk amorphous alloy parts is partial crystallization due to either slow cooling or impurities in the raw material.

Bulk-solidifying amorphous alloys have been made in a variety of metallic systems. They are generally prepared by quenching from above the melting temperature to the ambient temperature. Generally, high cooling rates such as one on the order of $10^{5\circ}$ C./sec, are needed to achieve an amorphous structure. The lowest rate by which a bulk solidifying alloy can be cooled to avoid crystallization, thereby achieving and maintaining the amorphous structure during cooling, is referred to as the "critical cooling rate" for the alloy. In order to achieve a cooling rate higher than the critical cooling rate, heat has to be extracted from the sample. Thus, the thickness of articles made from amorphous alloys often becomes a limiting dimension, which is generally referred to as the "critical (casting) thickness." A critical thickness of an amorphous alloy can be obtained by heat-flow calculations, taking into account the critical cooling rate.

Until the early nineties, the processability of amorphous alloys was quite limited, and amorphous alloys were readily available only in powder form or in very thin foils or strips with a critical thickness of less than 100 micrometers. A class of amorphous alloys based mostly on Zr and Ti alloy systems was developed in the nineties, and since then more amorphous alloy systems based on different elements have been developed. These families of alloys have much lower critical cooling rates of less than $10^{3\circ}$ C./sec, and thus they have much larger critical casting thicknesses than their previous counterparts. However, little has been shown regarding how to utilize and/or shape these alloy systems into structural components, such as those in consumer electronic devices. In particular, pre-existing forming or processing methods often result in high product cost when it comes to high aspect ratio products (e.g., thin sheets) or three-dimensional hollow products. Moreover, the pre-existing methods can often suffer the drawbacks of producing products that lose many of the desirable mechanical properties as observed in an amorphous alloy.

Alloys can be made by intertwining metal wires together, or by placing sheets of alloys or metals together, and then heating to a temperature sufficient to cause intermetallic diffusion. Some processes are disclosed in, for example, U.S. Pat. Nos. 4,830,262, 5,198,043, 5,741,604, and U.S. Patent Application Publication No. 2008/0029760 and 2010/0289003. While these processes may be suitable at times to produce crystalline alloys of various metals and amorphous alloy materials, they do not describe methods of making alloys of amorphous metals while maintaining the amorphous characteristics of the amorphous alloy.

Thus, there is a need to provide methods of making thicker amorphous alloy materials having varying properties across the cross-section, than can be made using conventional casting techniques that are limited by the critical casting thickness of the amorphous alloy.

SUMMARY

Described herein is a method of combining at least one bulk-solidifying amorphous alloy and at least one additional metal or alloy of a metal to provide an alloyed article having improved properties. In accordance with an embodiment, there is provided a method of making an alloy that includes providing at least one bulk-solidifying amorphous alloy having a dimension less than or equal to its critical dimension, providing at least one metal or alloy of the metal that is different from the bulk-solidifying amorphous alloy, and contacting the at least one bulk-solidifying amorphous alloy with the at least one metal or alloy of the metal to provide a composite article. The method also includes heating the composite article to a temperature greater than the glass transition temperature and lower than the melting temperature of the bulk-solidifying amorphous alloy, and then cooling the composite article to form an amorphous alloyed article.

In accordance with another embodiment, there is provided a method of making a core/shell composite article that includes providing at least one bulk-solidifying amorphous alloy having a dimension less than or equal to its critical dimension, providing at least one metal or alloy of the metal that is different from the bulk-solidifying amorphous alloy, and positioning the metal or alloy of the metal around at least a portion of the bulk-solidifying amorphous alloy to form a core/shell composite article. The method also includes heating the core/shell composite article to a temperature greater than the glass transition temperature and lower than the melting temperature of the bulk-solidifying amorphous alloy, and then cooling the core/shell composite article to form a core/shell amorphous alloyed article having at least an amorphous core.

In accordance with another embodiment, there is provided a method of making a core/shell composite article that includes providing at least one bulk-solidifying amorphous alloy having a dimension less than or equal to its critical dimension, providing at least one metal or alloy of the metal that is different from the bulk-solidifying amorphous alloy, and positioning the metal or alloy of the metal within at least a portion of the bulk-solidifying amorphous alloy to form a core/shell composite article. The method also includes heating the core/shell composite article to a temperature greater than the glass transition temperature and lower than the melting temperature of the bulk-solidifying amorphous alloy, and then cooling the core/shell composite article to form a core/shell amorphous alloyed article having at least an amorphous surface.

In accordance with another embodiment, there is provided a method of making a composite article that includes providing at least one bulk-solidifying amorphous alloy having a dimension less than or equal to its critical dimension, providing at least one metal or alloy of the metal that is different from the bulk-solidifying amorphous alloy, and contacting the at least one bulk-solidifying amorphous alloy with the at least one metal or alloy of the metal to provide a composite article. The method also includes heating the composite article to a temperature greater than the melting temperature of the bulk-solidifying amorphous alloy, and then cooling the composite article in such a manner to avoid crystallization of the bulk-solidifying amorphous alloy, to form an amorphous alloyed article.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
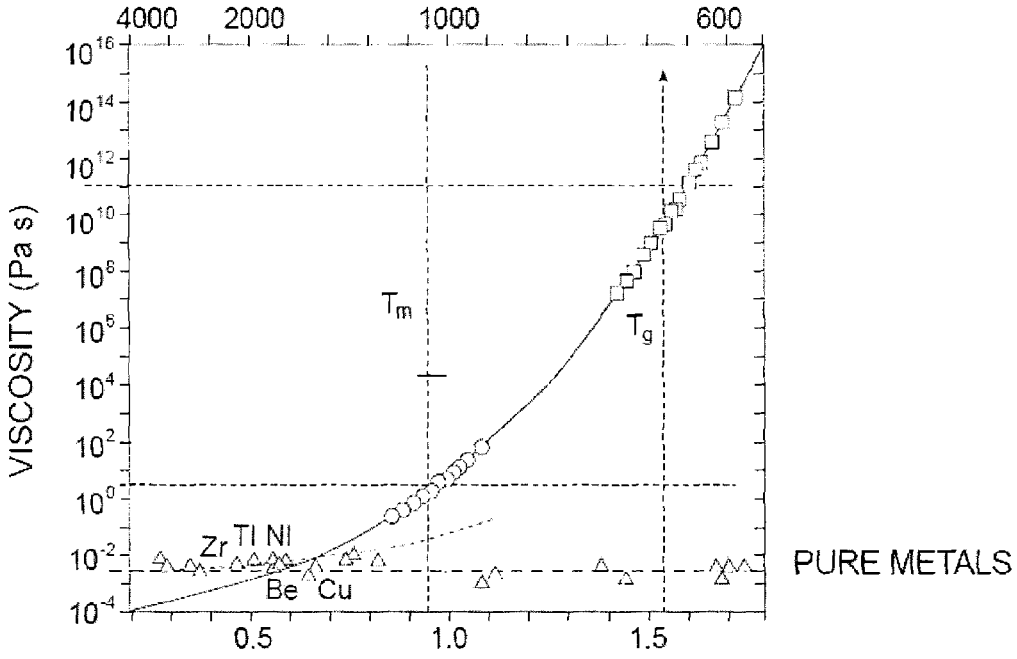
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
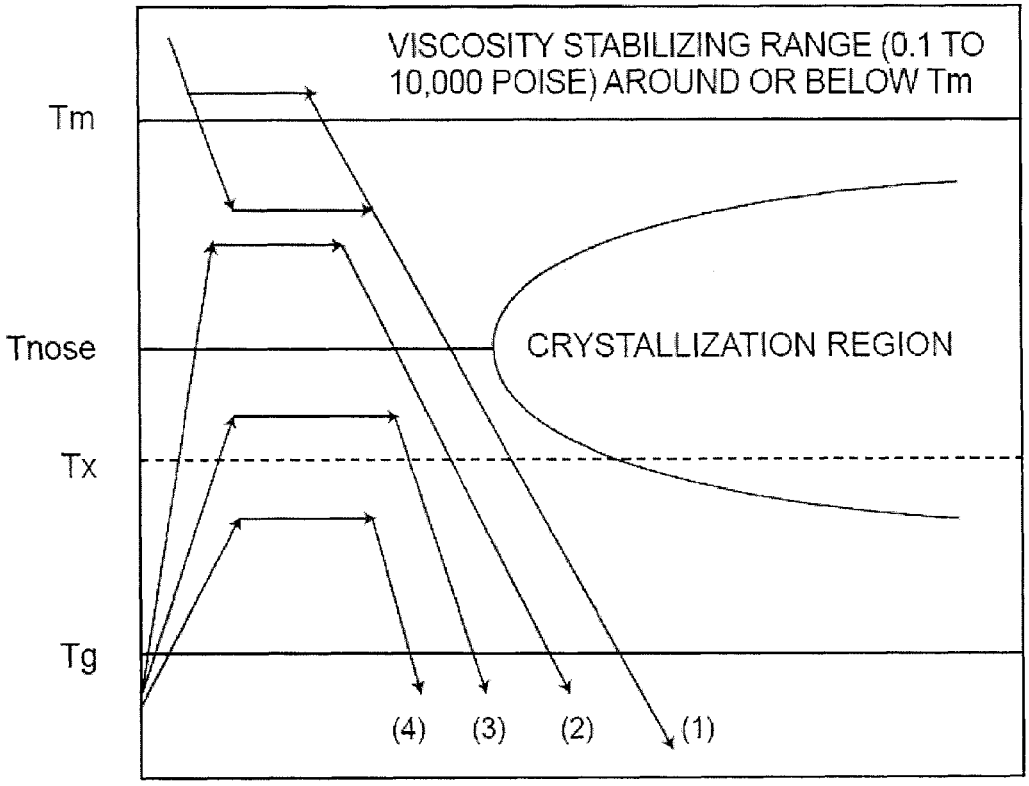
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between 1012 Pa s at the glass transition temperature down to 105 Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substeantially simultaneously with fast cooling to avoid the trajectory hitting the TTT curve. The procssing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function:

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula (Zr, Ti)a(Ni, Cu, Fe)b(Be, Al, Si, B)c, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula (Zr, Ti)a(Ni, Cu)b(Be)c, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula (Zr, Ti)a(Ni, Cu)b(Be)c, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula (Zr)a(Nb, Ti)b(Ni, Cu)c(Al)d, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is Fe72Al5Ga2P11C6B4. Another example is Fe72Al7Zr10Mo5W2B15. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

TABLE 1

Exemplary amorphous alloy compositions

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | Sn | |
| | 50.75% | 36.23% | 4.03% | 9.00% | 0.50% | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Au | Ag | Pd | Cu | Si | |
| | 49.00% | 5.50% | 2.30% | 26.90% | 16.30% | |
| 13 | Au | Ag | Pd | Cu | Si | |
| | 50.90% | 3.00% | 2.30% | 27.80% | 16.00% | |
| 14 | Pt | Cu | Ni | P | | |
| | 57.50% | 14.70% | 5.30% | 22.50% | | |
| 15 | Zr | Ti | Nb | Cu | Be | |
| | 36.60% | 31.40% | 7.00% | 5.90% | 19.10% | |
| 16 | Zr | Ti | Nb | Cu | Be | |
| | 38.30% | 32.90% | 7.30% | 6.20% | 15.30% | |
| 17 | Zr | Ti | Nb | Cu | Be | |
| | 39.60% | 33.90% | 7.60% | 6.40% | 12.50% | |
| 18 | Cu | Ti | Zr | Ni | | |
| | 47.00% | 34.00% | 11.00% | 8.00% | | |
| 19 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition $Fe_{48}Cr_{15}Mo_{14}Y_2C_{15}B_6$. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P, C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions $Fe_{80}P_{12.5}C_5B_{2.5}$, $Fe_{80}P_{11}C_5B_{2.5}Si_{1.5}$, $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, described in U.S. Patent Application Publication No. 2010/0300148. Some additional examples of amorphous alloys of different systems are provided in Table 2.

TABLE 2

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Embodiments

The embodiments described herein relate to methods of making an alloy that includes providing at least one bulk-solidifying amorphous alloy having a dimension less than or equal to its critical dimension, providing at least one metal or alloy of the metal that is different from the bulk-solidifying amorphous alloy, and contacting the at least one bulk-solidifying amorphous alloy with the at least one metal or alloy of the metal to provide a composite article. The method also includes heating the composite article to a temperature greater than the glass transition temperature and lower than the melting temperature of the bulk-solidifying amorphous alloy, and then cooling the composite article to form an amorphous alloyed article.

In accordance with another embodiment, there is provided a method of making a core/shell composite article that includes providing at least one bulk-solidifying amorphous alloy having a dimension less than or equal to its critical dimension, providing at least one metal or alloy of the metal that is different from the bulk-solidifying amorphous alloy, and positioning the metal or alloy of the metal around at least a portion of the bulk-solidifying amorphous alloy to form a core/shell composite article. The method also includes heating the core/shell composite article to a temperature greater than the glass transition temperature and lower than the melting temperature of the bulk-solidifying amorphous alloy, and then cooling the core/shell composite article to form a core/shell amorphous alloyed article having at least an amorphous core.

In accordance with another embodiment, there is provided a method of making a core/shell composite article that includes providing at least one bulk-solidifying amorphous alloy having a dimension less than or equal to its critical dimension, providing at least one metal or alloy of the metal that is different from the bulk-solidifying amorphous alloy, and positioning the metal or alloy of the metal within at least a portion of the bulk-solidifying amorphous alloy to form a core/shell composite article. The method also includes heating the core/shell composite article to a temperature greater than the glass transition temperature and lower than the melting temperature of the bulk-solidifying amorphous alloy, and then cooling the core/shell composite article to form a core/shell amorphous alloyed article having at least an amorphous core.

The embodiments take advantage of the use of a core/shell perform that includes at least one bulk-solidifying amorphous alloy that ultimately forms a metal alloy having improved interdiffusion of the metal to form the alloy material. Use of the core/shell perform provides more intimate contact between the respective materials (e.g., the bulk-solidifying amorphous alloy may form the core or a portion of the core, or it may form the shell or a portion of the shell) so that improved interdiffusion takes place upon heating of the composite article. The embodiments also enable the production of a metal alloy that retains many, if not all, of the characteristics of the bulk-solidifying amorphous alloy material, but also may contain other desirable characteristics (e.g., more ductile material in the center or on the outside) attributable to the other metal or alloy present. The embodiments also make it possible to form articles having critical thicknesses far greater than the critical casting thickness of the bulk-solidifying amorphous alloy.

Figure 3:
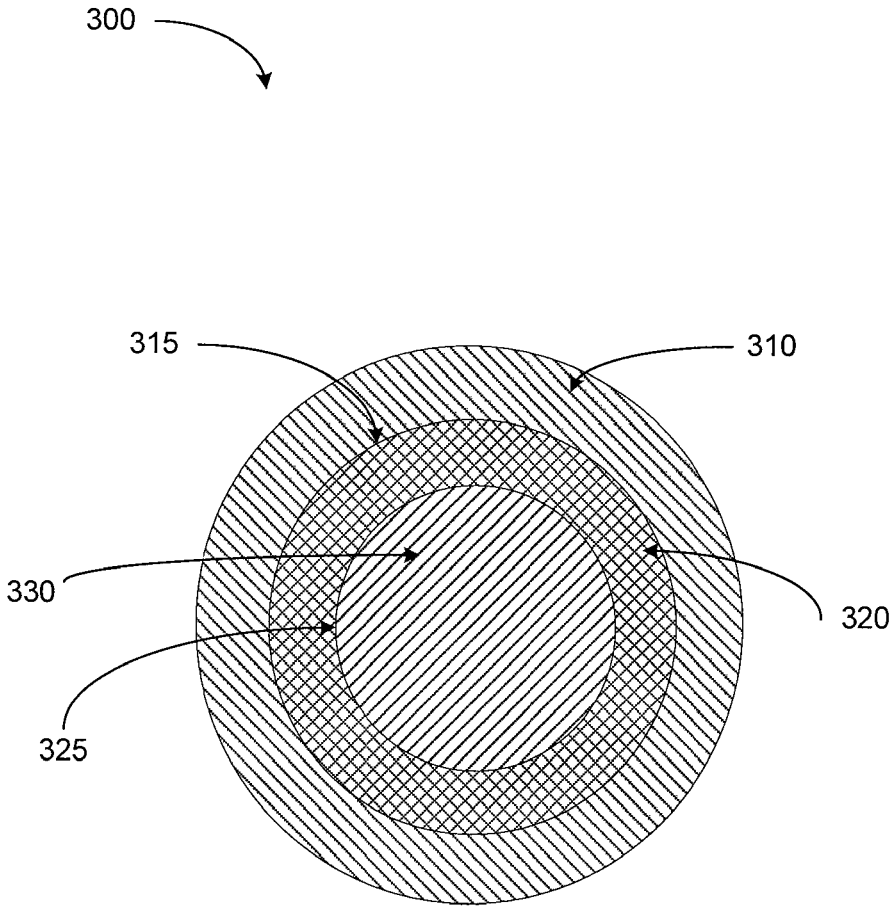
FIG. 3 illustrates an embodiment of a pre-form that can be used in preparing an alloy in accordance with an embodiment.

FIG. 3 illustrates a preform that can be used to make an alloy in accordance with certain embodiments. While FIG. 3 illustrates a three-component system, those skilled in the art will recognize that the preform can be comprised of only two components, or can be comprised of more than three components. As illustrated in FIG. 3, preform 300 includes a core material 330, surrounded by a first material 320, and optionally, a second material 310. The bulk-solidifying amorphous alloy may be any one of the core, first material, or second material, or, if additional materials are utilized, the bulk-solidifying amorphous alloy may be any of the materials, including more than one. For example, a bulk-solidifying amorphous alloy material may be used as core 330, a more ductile metal or alloy, e.g., aluminum, titanium, lead, antimony, bronze, copper, palladium, platinum, etc., may be first material 320, and the same or a different bulk-solidifying amorphous alloy may be the second material 310.

Preform 300 is shown in FIG. 3 as a spherical material, but the particular geometry of the preform is not critical to the invention. For example, preform may be in the form of a cylindrical rod in which the various materials are wound around one another, or as a cylindrical rod in which the various materials are stacked on top of one another. Other shapes include square or rectangular, oval or ovoids, prismatic shapes, pyramidal, and the like. Fabrication of the preform can take place by forming the core material 330 in its desirable shape for further processing. The first material 320 then can be cast over at least one surface 325 of the core material 330, or first material 320 can be in the form of an already formed sheet that is wrapped around core 330 (e.g., wrapping like a thin film or foil is wrapped around an object). The core/shell arrangement is preferred because it results in contact with the entire surface 325 of core material 330. Similarly, the second material 310, if used, then can be cast over at least one surface 315 of second material 320, or second material 310 may be in the form of an already formed sheet that is wrapped around core 330.

Upon formation of the preform, which may or may not be in the final desired shape for the ultimate alloy, the preform is heated to a temperature above the glass transition temperature of the bulk-solidifying amorphous alloy, but below its melting temperature or below its temperature of crystallization. Heating serves to fuse the materials together, and provide interdiffusion at interface 325, and if second material 310 were used, at interface 315. The final alloy then can be used as is, or can be further shaped and formed into the final article. Because the bulk-solidifying amorphous alloy now has formed a different alloy material, it is possible now to form final articles having critical casting thicknesses smaller or greater than the critical casting thickness of the bulk-solidifying amorphous alloy material alone. In one embodiment, the final formed article has a dimension that exceeds the critical casting thickness of the bulk solidifying amorphous alloys.

In embodiments herein, the existence of a supercooled liquid region in which the bulk-solidifying amorphous alloy can exist as a high viscous liquid allows for superplastic forming. The bulk-solidifying amorphous alloy exists as a supercooled liquid when heated above its glass transition temperature and below its crystallization temperature. It is believed that the unique rheological properties of the bulk-solidifying amorphous alloy materials in the supercooled liquid state, large plastic deformations can be obtained, and wetting may take place in the supercooled liquid state. The ability to undergo large plastic deformation in the supercooled liquid region is used for the forming and/or cutting process. As opposed to solids, the liquid bulk solidifying alloy deforms locally, which drastically lowers the required energy for cutting and forming. The ease of cutting and forming depends on the temperature of the alloy, the mold, and the cutting tool. As temperature is increased, viscosity decreases, and consequently, it is easier to cut and form the final article.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature. Many bulk-solidifying amorphous alloy materials having a melting point on the order of about 800° C. Many non-amorphous metals to which the bulk-solidifying amorphous alloy material may be joined to form a preform and then alloyed, have melting points below that of the bulk-solidifying amorphous alloy material. Because these additional metals or metal alloys to which the bulk-solidifying amorphous alloy material is ultimately alloyed are not amorphous, heating them to above their melting point is not of great concern, and indeed, may serve to further facilitate interdiffusion of certain elements during formation of the final article.

The amorphous alloy component typically has a critical casting thickness, and the final part preferably has a thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature Tx.

The preform can be heated up to the crystallization temperature Tx of the bulk-solidifying amorphous alloy. Upon heating, the preform will soften and/or melt, thereby welding together the various materials (e.g., core material 330, second material 320, and optionally first material 310, and more materials if desired) together to form a metal alloy that contains at least an amorphous phase comprised of the bulk-solidifying amorphous alloy. The preform can be heated for a period of time sufficient to fully alloy the respective materials, which can range anywhere from about 5 minutes to about 10 hours, or from about 15 minutes to about 5 hours, or from about 25 minutes to about 3 hours.

The preform material that includes the bulk-solidifying amorphous alloy and the at least one additional metal or metal alloy can be heated to form the final article and alloy the respective materials using a liquid phase diffusion bonding techniques. Liquid phase diffusion bonding is a joining technique interposing an insert material having a melting point lower than the joined members, for example, an amorphous metal or amorphous alloy, at the joining surfaces, heating to a temperature higher than a liquidus temperature of the insert material and a temperature lower than the melting point of the joined members, causing the joined parts to melt, and causing isothermal solidification. The amorphous metal, amorphous alloy, or other insert material may, for example, be used in a foil, powder, plating, or other form. In the embodiments, the bulk-solidifying amorphous alloy is used as an already formed metal sheet, roll, disc, ball, or the like.

This liquid phase diffusion bonding may be applied to joining of stainless steel, high nickel-based alloys, heat resistant steel alloy steels, and other steels difficult to weld by conventional welding methods. Furthermore, according to liquid phase diffusion bonding, it is possible to simultaneously join a large number of locations. Further, when joining members with large cross-sectional areas of the joined parts, the required time does not greatly increase. For this reason, for the purpose of reducing installation costs, liquid phase diffusion bonding is now also being applied even to steel materials able to be joined by welding.

The preform then can be cooled to form a final article, or can be cooled to be combined with other metals or alloys and then formed into a final article, or can be directly formed into a final article using a thermoforming process, or any other process capable of forming a metal alloy into its final shape, when that metal alloy contains at least a bulk-solidifying amorphous alloy material.

Cooling may be carried out at rates similar to the heating rates, and preferably at rates greater than the heating rates at the heating step. The cooling also may be achieved preferably while the forming and shaping loads are still maintained—e.g., while forming the final article into its desired shape and size.

In an embodiment, the preform includes at least a bulk-solidifying amorphous alloy component as either the core material 330, the second material 320, and/or the first material 310. The preform in certain embodiments also includes an additional metal or metal alloy to modify the properties of the bulk-solidifying amorphous alloy material. The additional metal or metal alloy can be selected depending on the final properties desired in the ultimate article.

For example, the additional metal or metal alloy may contain Co, Si and/or B as the main component or as an additive alloying element to improve certain physical properties such as hardness, yield strength and glass transition temperature. A higher content of these elements in an alloy is preferred for alloys having higher hardness, higher yield strength, and higher glass transition temperature.

Another possible metal or metal alloy that can be used in the embodiments includes the alloying element of Cr. The addition of Cr is preferred for increased passivation/corrosion resistance especially in aggressive environment. In embodiments, the addition of Cr can be less than about 10 atomic percent and preferably less than about 6 atomic percent. In embodiments, Cr can be added, for example, at the expense of the Cu group (Cu, Ni, and Co).

Other additive alloying elements of interest include Ir and Au. These elements can be added as a fractional replacement of the main alloying element, such as zirconium, platinum, or copper. The total amount of these elements should be less than about 10 atomic percentage and preferably less than about 5 atomic percentage.

Other alloying elements of potential interest include Ge, Ga, Al, As, Sn and Sb, which can be used as a fractional replacement of the main element used in the bulk-solidifying amorphous alloy material (Zr, Pt, Cu, etc.). The total addition of such elements as replacements for the main element should be less than about 5 atomic percentage and preferably less than about 2 atomic percentage.

The metal or metal alloy that is different from the bulk-solidifying amorphous alloy can be a "non-amorphous" metal, which denotes a metal that is normally non-amorphous in both that it has a different composition and that it is a conventional crystalline metal in the case of a metal. Suitable metals or metal alloys that are non-amorphous metals may be chosen from any suitable non-amorphous metals including, for example, metals or alloys of aluminum, bismuth, cobalt, copper, gallium, gold, indium, iron, lead, magnesium, mercury, nickel, potassium, plutonium, rare earth alloys, rhodium, silver, titanium, tin, uranium, zinc, zirconium, etc.

The bulk-solidifying amorphous alloy material may form any one or more of the preform constituent layers, and the preform may be in the form of a sphere, a rod, a square, rectangular, prism, pyramid, washer, disc, or any other suitable shape for forming an alloy between the bulk-solidifying amorphous alloy and the at least one metal or metal alloy. The formation of the alloy from the preform then can be carried out by heating the preform to a temperature above the glass transition temperature of the bulk-solidifying amorphous alloy but below its crystallization temperature. The specific temperature range will depend in part on the composition of the bulk-solidifying amorphous alloy material used, and those skilled in the art are capable of determining a suitable temperature range depending on the composition of the bulk-solidifying amorphous alloy, as well as the other metal or metal alloy (or metals or metal alloys, or additional bulk-solidifying amorphous alloys used).

Generally, the alloy formation process in the embodiments requires an application of heat to allow the respective materials to reach a temperature profile suitable for interdiffusion of the metals and alloys, and optionally, at a suitable pressure to bring the interface surfaces (315, 325) together to form the alloy. However, there are many different ways of applying heat, and optionally pressure, that can be used in accordance with the embodiments. Exemplary methods can be understood with reference to the continuous cooling transformation (CCT) schematic provided in FIG. 2. For clarity, the region in the bottom of FIG. 2 represents the solid phase while both crystalline and supercooled liquid occupy the upper portion of the diagram.

Suitable heating temperatures can range from about 100° C. to about 1,600° C., or from about 150° C. to about 1,000° C., or from about 175° C. to about 800° C., or from about 100° C. to about 750° C. In an embodiment, the preform also is subjected to pressure during the heating. In one embodiment, the alloy is formed from the preform using a thermoplastic process. This thermoplastic process is based on the unique rheological behavior and pattern-replication ability of bulk-solidifying amorphous alloys. More specifically, the method relies on three unique properties of these materials: (i) that an amorphous solid bulk-solidifying amorphous alloy specimen may be processed as a thermoplastic when heated above its glass transition temperature (Tg); (ii) that the Tg of these bulk-solidifying amorphous alloy materials is typically substantially below the melting temperature (Tm) of the material; and that the viscosity of these bulk-solidifying amorphous alloy materials continues to decrease with increasing temperature.

As shown in FIG. 2, under this thermoplastic process the bulk-solidifying amorphous alloy is heated to a temperature between the bulk-solidifying amorphous alloy material's glass transition (Tg) and melting (Tm) temperatures, and optionally, below its crystallization (Tx) temperature. At this temperature the bulk-solidifying amorphous alloy becomes a supercooled liquid. Because of the unique rheological properties of these bulk-solidifying amorphous alloys, wetting may take place in this supercooled liquid state as opposed to a molten state (above Tm) as would be required with a conventional solder material. Supercooled liquids, depending on their fragility, can have enough fluidity to spread under minor pressure. The fluidity of supercooled liquids of bulk-solidifying amorphous alloys is on par with thermoplastics during plastic injection molding. As a result, bulk-solidifying amorphous alloys under these thermoplastic conditions can be used as a thermoplastic joining material.

During the operation of the thermoplastic process the preform containing the bulk-solidifying amorphous alloy and at least one additional metal or metal alloy is heated to a temperature above glass transition temperature, into the supercooled Liquid region. The preferred processing temperature is usually lower than the alloy's melting temperature and the crystallization kinetics are slow. As a result, the part can be held in the amorphous, supercooled liquid for a few minutes up to hours depending upon the particular amorphous alloy being used. Optionally this heating may be followed by mechanically pressing the preform to minimize shrinkage and movement of the respective materials. The assembly then may be cooled to room temperature.

In a thermoplastic process, the temperature (about Tg) is "decoupled" from the melting temperature of the bulk-solidifying amorphous alloy material (Tm). As a consequence, low temperature thermoplastic alloy formation can be achieved without lowering the melting temperatures of the bulk-solidifying amorphous material, allowing for improved alloy materials. Moreover, after forming the alloy, a wide variety of nano/microstructures from fully amorphous, partially-crystallized to fully-crystallized structures can be obtained through controlled crystallization via post-bonding annealing for optimum electrical conductivity, creep and fatigue properties tailored to a given application. It has been surprisingly discovered that this technique posts significant advantage over conventional alloying methods, such as soldering, because the glass transition temperatures of the bulk-solidifying amorphous alloys are much lower than their melting point. Indeed, the amorphous thermoplastic alloying technique described herein typically requires a processing temperature range at a few hundred degrees (Celsius) below those required by conventional alloying methods such as soldering, welding or brazing. As a result the deleterious effects of heat-effected zones, brittle oxide layers and unstable intermetallics typically found in conventional alloying techniques can be reduced or eliminated.

Judiciously selecting the amorphous alloy system permits the thermoplastic alloying technique to be used for a wide variety of bulk-solidifying amorphous alloy-to-metal preforms, and is not limited to the applications found in any specific industry. Suitable processing conditions will depend on the different alloy family and composition, a fuller description of which is provided below. For an example, a processing temperature may be 30-60° C. above Tg for gold and platinum based metals or metal alloy-containing preforms. The Tg for one particular gold-bulk-solidifying amorphous alloy preform can be about 130° C. (J. Schroers, B. Lohwongwatana, W. L. Johnson and A. Peker, Applied Physics Letters 87 061912 (2005)), which means the thermoplastic alloying process could be conducted at 160-170° C., which is significantly below the 210-230° C. processing temperature window for a conventional Sn-based solder. The method of forming the alloy therefore takes place at a temperature outside the crystallization window shown in FIG. 2, and alloys interdiffusion between the bulk-solidifying amorphous metal and the at least one other metal or alloy of that metal.

Suitable embodiments for forming an alloy from the preform described herein are described below. In one embodiment, embodiment A, the preform can be heated to a temperature above Tm. A pressure of about 150 pounds per square inch (psi) may be applied at that temperature. Inasmuch as there is substantially no tendency to transform to the crystalline state at this temperature, the preform may be held at that temperature for an indefinitely long period until full contact along the interfaces 315, 325 is achieved. For the purposes of determining the required cooling rate, the cooling rate should be sufficiently high that the cooling portion does not enter the crystalline field, which means that the cooling process should miss the nose of the crystalline field (FIG. 2). The selected cooling rate will usually be chosen to be the slowest cooling rate so that the preform passes by the nose, within the minimum clearance permitted by experimental or commercial tolerances. In common with quenching and cooling practice generally, overly high cooling rates can lead to high internal stresses within the pieces 310, 320, and/or 320. It therefore may be preferred in some cases to use the embodiment B described below.

Another embodiment (embodiment B) includes an alloying processing conducted entirely below Tx. The bulk-solidifying amorphous alloy and at least the adjacent portions of the at least one metal or alloy of that metal can be heated to a temperature above Tg but below Tx, the region where the crystalline phase field is receding downwardly and to the right (FIG. 2). The alloying pressure then can be applied at this temperature. The alloying pressure typically is higher than the pressure described in embodiment A above, because the viscosity of the bulk-solidifying amorphous material is higher at reduced temperature. At such a temperature, the time to transform to the crystalline state does not necessarily have to be translated back to the origin at the commencement of cooling as was the case for the embodiment described immediately above. Heating to the processing temperature is therefore normally performed reasonably rapidly, to permit as much time as possible for alloying and cooling, and to allow sufficient interdiffusion to form the alloy. Cooling should be started and should be sufficiently rapid to miss the crystalline state field. Accordingly, the crystallization temperature Tx should exceed the glass transition temperature Tg by an amount sufficient to permit the processing to be conducted in the interval between the two temperatures. It has been determined that, for conventional commercial practice, (Tx-Tg) should be at least about 30° C.

The approach of embodiment A achieves alloying in a short time and with a low joining pressure, but requires relatively rapid cooling and therefore leads to a greater susceptibility to internal stresses within the final structure. The approach of embodiment B requires a higher alloying pressure but is less susceptible to a buildup of internal stresses. Since the approach of embodiment B uses a lower temperature, it would be more suitable where one or all of the pieces the form the preform 300 are previously heat treated to a particularly desirable structure or are themselves susceptible to thermal degradation. The selected approach will depend upon the geometries, structural heat sensitivity, and susceptibility to internal stresses (which could lead to bending or possible cracking) of the respective materials of the preform structure 300.

The selected alloying processing sequence also depends upon the position and shape of the crystalline state field. FIG. 2 shows the nose of the crystalline state field at a time in the range of 1-100 minutes, which is typical for the compositions of the alloying elements to be discussed subsequently. Further innovations may be successful in moving the nose to longer times, permitting more flexibility in selecting processing sequences. If the nose can be moved sufficiently far to the right, joining processing sequences with processing temperatures between Tx and Tm, combined with a processing time and cooling rate to miss the nose of the crystalline field, may be practical in many situations.

The alloying processing can be determined in conjunction with the selection of the composition of the bulk-solidifying amorphous alloy. The initial composition of the bulk-solidifying amorphous alloy should be such that, after preform 300 is prepared, the entire preform may be processed in the amorphous state. This type of information regarding the stability to compositional variations is desirably available for candidate materials for the alloying preform 300. If not, the information can be determined by reference to FIG. 4, which illustrates a quaternary phase diagram that has proved useful in the analysis.

A candidate initial composition for the bulk-solidifying amorphous alloy material may be selected, based in part upon the specific at least one metal or alloy of that metal that will be used to form the preform 300. The initial composition should be capable of retaining an amorphous structure after cooling at a sufficiently high rate that is suitable for the proposed processing. It is preferred that the initial composition comprise at least three intentionally provided elements, as such compositions are found to be the most suitable for partial modification to the associated composition without loss of the ability to reach the amorphous state. The candidate composition is one that is known to be chemically and physically compatible with at least one metal or alloy of that metal in preform 300. In some embodiments, the bulk-solidifying amorphous alloy also may include some of the principal element(s) found in the at least one metal or alloy of that metal in preform 300. As an example, if one of the metals in preform 300 is a titanium-base alloy (e.g., first material 310) and another metal is a zirconium-base alloy (e.g., second material 320), the preferred bulk-solidifying amorphous alloy composition (e.g., core material 330) may either contain both titanium and zirconium, or is known to be tolerant of the presence of titanium and zirconium while retaining the amorphous state after processing. By this selection approach, there is a degree of certainty that there will be tolerated at least some additional material diffused into the joining element.

A number of specimens of a suitable bulk-solidifying amorphous material may be prepared, and then placed into contact with the at least one metal or metal alloy forming the preform 300, thus forming a series of trials. The trials then can be processed according to select alloying methods, and evaluated to determine whether the bulk-solidifying amorphous material remained entirely amorphous. Those specimens that are entirely amorphous are concluded to be within a suitable alloying composition range.

Figure 4:
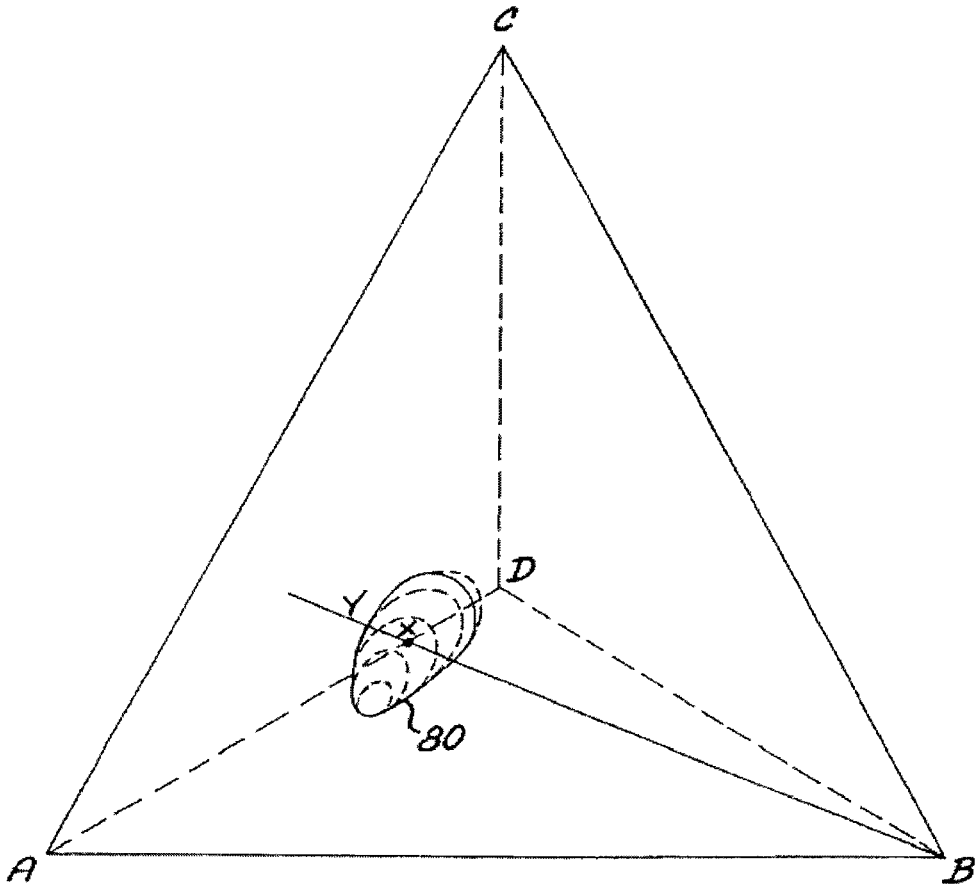
FIG. 4 illustrates a quaternary phase diagram illustrating a compositional range for forming an alloy from an alloy preform.

FIG. 4 illustrates a tetrahedral-plot approach for depicting the alloying composition range for a four component alloy system (A,B,C,D) wherein the alloy system includes, for example, an element B that is a principal component of the at least one metal or alloy of that metal. The alloy system (A, B, C, D) is known to be capable of achieving the amorphous state in at least some circumstances. A candidate initial composition for the bulk-solidifying amorphous alloy is selected and indicated on the plot of FIG. 4, for example, as point Y. Diffusion couples between alloys Y and B, prepared and analyzed according to the approach described above or by preparing and analyzing specimens of specific compositions, are plotted as to whether they are amorphous or crystalline. A surface drawn to divide the amorphous and crystalline regions then is the alloying composition range 80.

The composition Y should be suitable for forming an alloy when in contact with the at least other metal or alloy of metal, for example, element B, as just discussed, and also with any other metals or alloys of those metals used to form preform 300. If additional metals or alloys of those metals are of the same composition as element B, no evaluation is required. If, on the other hand, the additional metals or alloys of those metals have a different principal constituent, e.g., element A, the stability of candidate composition Y as against A should also be determined. While seemingly complex, this evaluation process is straightforward in practice and well within the skill of those in the art, when using the guidelines provided herein.

Another suitable method for forming the alloy from the preforms described herein includes a deep undercooling process. This processing technique utilizes the deeply undercooling characteristic of bulk-solidifying amorphous alloys to form a liquid material that can be used to create alloys that can be amorphous, crystalline or partially crystalline.

In one process, a glassy alloy may be formed using a deeply undercooled glass forming liquid. In such a technique, the preform is first melted above Tm of the bulk-solidifying amorphous alloy, then quickly quenched to low temperature. The bulk-solidifying amorphous alloy portion of the preform has a stability against crystallization that allows the melted preform to "vitrify" or freeze in the amorphous state when the melt is deeply undercooled to below Tg. Once the temperature of the bulk-solidifying amorphous alloy material has been brought below Tg, it can then be further quenched to room temperature. The resulting alloy may be fully amorphous if the cooling rate is sufficient to bypass crystallization as shown in the curve of FIG. 2.

It is not a coincidence that good glass forming liquids deeply undercool before crystallization takes place. In other words, the liquid metal needs to undercoat deeply enough so that the temperature is low, the atomic mobility is restricted, and the atoms become "frozen" before they form crystals. Such a deep undercoating process also improves the chance that the preform will solidify as an amorphous metal alloy.

Another alloying method provides an alloy that may have one or more crystalline or semi-crystalline phases. This method takes advantage of the deep undercoating properties of the bulk-solidifying amorphous alloy, but does not require the cooling rate to be fast enough to bypass the crystallization event. Crystallization still takes place, but the undercoating is large enough to minimize solidification shrinkage. There have been reports that crystalline-metallic glass composites have favorable mechanical properties, such as improved ductility, which would result in a more reliable alloy material. (See, C. C. Hays, C P Kim and W. L. Johnson, Physical Review Letters 84, 2901-2904 (2000))

In another embodiment, the preform is subjected to plastic processing to form the alloy material. In this embodiment, plastic processing of the preform from the molten state is utilized. In this process the preform is heated above the melting temperature, then injected into a mold that is being held at a predetermined lower temperature. The preform is cooled to the deep supercooled liquid region quickly enough to avoid crystallization, at which point it can undergo thermoplastic processing. This process is similar to casting, but the preform is held below the crystallization "nose" (see FIG. 2) for a longer time, where it can be processed like a plastic. In such a method the temperature at which the thermoplastic processing takes place can be controlled by the mold's temperature.

While the invention has been described in detail with reference to particularly preferred embodiments, those skilled in the art will appreciate that various modifications may be made thereto without significantly departing from the spirit and scope of the invention.

What is claimed is:

1. A method of making an alloy, comprising:

positioning a first bulk-solidifying amorphous alloy having a dimension that is less than or equal to its critical dimension in contact with a second bulk-solidifying amorphous alloy different from the first bulk-solidifying amorphous alloy, thereby forming a composite alloy preform;

heating the composite alloy preform to a temperature greater than the glass transition temperature and lower than the melting temperature of at least the first bulk-solidifying amorphous alloy to form an alloy; and cooling the alloy.

2. The method of claim 1, further comprising subjecting the composite alloy preform to pressure while heating.

3. The method of claim 1, wherein heating is carried out at a temperature of from about 100° C. to about 1,600° C.

4. The method of claim 1, wherein heating is carried out at a temperature of from about 100° C. to about 750° C.

5. The method of claim 1, wherein at least one component of the second bulk-solidifying amorphous alloy is selected from the group consisting of metals or alloys of aluminum, bismuth, cobalt, copper, gallium, gold, indium, iron, lead, magnesium, mercury, nickel, potassium, plutonium, rare earth alloys, rhodium, silver, titanium, tin, uranium, zinc, zirconium, and mixtures thereof.

6. The method as claimed in claim 1, wherein the first bulk-solidifying amorphous alloy is described by the following molecular formula: $(Zr, Ti)_a(Ni, Cu, Fe)_b(Be, Al, Si, B)_c$, wherein "a" is in the range of from 30 to 75, "b" is in the range of from 5 to 60, and "c" is in the range of from 0 to 50 in atomic percentages.

7. The method as claimed in claim 1, wherein the first bulk-solidifying amorphous alloy is described by the following molecular formula: $(Zr, Ti)_a(Ni, Cu)_b(Be)_c$, wherein "a" is in the range of from 40 to 75, "b" is in the range of from 5 to 50, and "c" is in the range of from 5 to 50 in atomic percentages.

8. The method as claimed in claim 1, wherein the first bulk solidifying amorphous alloy can sustain strains up to 1.5% or more without any permanent deformation or breakage.

9. A method of making a composite alloy, comprising:

positioning a metal or a metal alloy around at least a portion of a bulk-solidifying amorphous alloy different from the metal or metal alloy and having a dimension that is less than or equal to a critical dimension of the bulk-solidifying amorphous alloy, thereby forming a core/shell composite alloy preform;

heating the core/shell composite alloy preform to a temperature greater than the glass transition temperature and lower than the melting temperature of the bulk-solidifying amorphous alloy to form a core/shell composite alloy; and cooling the core/shell composite alloy to form a core/shell amorphous alloyed article having at least an amorphous core.

10. The method of claim 9, further comprising subjecting the core/shell composite alloy preform to pressure while heating.

11. The method of claim 9, wherein heating is carried out at a temperature of from about 100° C. to about 750° C.

12. The method of claim 9, wherein:

the bulk-solidifying amorphous alloy is a first bulk-solidifying amorphous alloy; and the at least one metal or metal alloy is a second bulk-solidifying amorphous alloy different from the first bulk-solidifying amorphous alloy.

13. The method of claim 9, wherein the at least one metal or alloy of the metal is selected from the group consisting of metals or alloys of aluminum, bismuth, cobalt, copper, gallium, gold, indium, iron, lead, magnesium, mercury, nickel, potassium, plutonium, rare earth alloys, rhodium, silver, titanium, tin, uranium, zinc, zirconium, and mixtures thereof.

14. The method as claimed in claim 9, wherein the bulk-solidifying amorphous alloy is described by the following molecular formula: $(Zr, Ti)_a(Ni, Cu, Fe)_b(Be, Al, Si, B)_c$, wherein "a" is in the range of from 30 to 75, "b" is in the range of from 5 to 60, and "c" is in the range of from 0 to 50 in atomic percentages.

15. The method as claimed in claim 9, wherein the bulk-solidifying amorphous alloy is described by the following molecular formula: $(Zr, Ti)_a(Ni, Cu)_b(Be)_c$, wherein "a" is in the range of from 40 to 75, "b" is in the range of from 5 to 50, and "c" is in the range of from 5 to 50 in atomic percentages.

16. The method as claimed in claim 9, wherein the bulk-solidifying amorphous alloy can sustain strains up to 1.5% or more without any permanent deformation or breakage.

17. A method of making a composite alloy, comprising:

positioning a first bulk-solidifying amorphous alloy within at least a portion of a second bulk-solidifying amorphous alloy different from the first bulk-solidifying amorphous alloy and having a dimension that is less than or equal to a critical dimension of the second bulk-solidifying amorphous alloy, thereby forming a core/shell composite alloy preform;

heating the core/shell composite alloy preform to a temperature greater than the glass transition temperature and lower than the melting temperature of at least the first bulk-solidifying amorphous alloy to form a core/shell composite alloy; and cooling the core/shell composite alloy to form a core/shell amorphous alloyed article having at least an amorphous surface.

18. A method of making an alloy comprising:

positioning a first bulk-solidifying amorphous alloy having a dimension that is less than or equal to its critical dimension in contact with a second bulk-solidifying amorphous alloy different from the first bulk-solidifying amorphous alloy, thereby forming a composite alloy preform;

heating the composite alloy preform to a temperature greater than the melting temperature of at least the first bulk-solidifying amorphous alloy to form an alloy; and cooling the alloy in such a manner to avoid crystallization of at least the first bulk-solidifying amorphous alloy.

* * * * *